US012221137B2

(12) United States Patent
Su

(10) Patent No.: US 12,221,137 B2
(45) Date of Patent: Feb. 11, 2025

(54) LARGE-SCALE POWER GENERATION METHOD USING ELECTRIC LOCOMOTIVE-DRIVEN GENERATORS

(71) Applicant: Ping Su, Shaanxi (CN)

(72) Inventor: Ping Su, Shaanxi (CN)

( * ) Notice: Subject to any disclaimer, the term of this patent is extended or adjusted under 35 U.S.C. 154(b) by 0 days.

(21) Appl. No.: 18/423,353

(22) Filed: Jan. 26, 2024

(65) Prior Publication Data

US 2024/0343273 A1 Oct. 17, 2024

(30) Foreign Application Priority Data

Apr. 14, 2023 (CN) ..... 202320834183.1
Sep. 12, 2023 (CN) ..... 202311178049.1

(51) Int. Cl.
*B61C 13/00* (2006.01)
*B61C 3/00* (2006.01)
*B61C 17/00* (2006.01)

(52) U.S. Cl.
CPC ..... *B61C 13/00* (2013.01); *B61C 3/00* (2013.01); *B61C 17/00* (2013.01)

(58) Field of Classification Search
CPC .. B61C 3/00; B61C 3/02; B61C 13/00; B61C 17/00; B61C 17/02; B61C 17/06; F03G 7/10
See application file for complete search history.

(56) References Cited

FOREIGN PATENT DOCUMENTS

| | | | | | |
|---|---|---|---|---|---|
| CN | 114076076 | A | * | 2/2022 | F03G 7/10 |
| DE | 102019126489 | A1 | * | 4/2021 | F03G 7/10 |
| KR | 20210009949 | A | * | 1/2021 | F03G 7/10 |
| KR | 20210147164 | A | * | 12/2021 | F03G 7/10 |
| WO | WO-2022086352 | A1 | * | 4/2022 | F03G 7/10 |

* cited by examiner

*Primary Examiner* — Robert J McCarry, Jr.

(57) ABSTRACT

A large-scale power generation method using electric locomotive-driven generators includes the following steps: step 1: setting up a circular railway, and running at least 10 electric locomotives on the circular railway; step 2: providing one or two 20 MW or 30 MW generators in each carriage; step 3: providing a multi-stage double-gear accelerated transmission device on a wheel axle, and driving a generator rotor to reach a rated speed for electricity production; and step 4: grid-connecting electricity produced by the generators, and allowing a small part of the produced electricity to pass through a shunt circuit to become a driving force for the continuous operation of the electric locomotives. And therefor the electromechanical interaction is formed.

5 Claims, 3 Drawing Sheets

LARGE-SCALE POWER GENERATION METHOD USING ELECTRIC LOCOMOTIVE-DRIVEN GENERATORS

CROSS REFERENCE TO RELATED APPLICATIONS

The present application claims the benefit of Chinese Patent Application Nos. 202320834183.1 filed on Apr. 14, 2023 and 202311178049.1 filed on Sep. 12, 2023. All the above are hereby incorporated by reference in their entirety.

TECHNICAL FIELD

The present disclosure belongs to a technical field of machinery and electricity, and specifically relates to a large-scale power generation method using electric locomotive-driven generators.

BACKGROUND

Large-scale power generation methods refer to power generation methods that can provide stable and reliable large-scale electricity supply, typically including thermal power generation, hydropower generation, and nuclear power generation, etc. These power generation methods require large power generation equipment and power grids, as well as high investment and maintenance costs. With the rapid development of renewable energy, some new large-scale power generation methods are gradually emerging, such as wind power generation, photovoltaic power generation, and biomass power generation. These power generation methods utilize natural resources and reduce environmental pollution and greenhouse gas emissions, but they are intermittent, fluctuating, and regional, and require energy storage technology and smart grid technology for regulation and optimization.

Therefore, a new power generation method that is low-carbon, economical, environmentally friendly, and safe is needed to solve the above problems.

SUMMARY

An objective of the present disclosure is to provide a large-scale power generation method using electric locomotive-driven generators to solve the problems mentioned in the background.

In order to achieve the above objective, the present disclosure provides the following technical solution.

A large-scale power generation method using electric locomotive-driven generators includes the following steps:

step 1: setting up a circular railway, on which run at least 10 electric locomotives, and each of the electric locomotives pulls at least 10 carriages;

step 2: providing one or two 20 MW or 30 MW generators in each of the carriages, where considering that a fewer pole number indicates a lighter weight, it is advisable to use 2-pole generators; if a generator stator is manufactured through a vacuum pressure impregnation process and a generator rotor is manufactured through an air-cooled process, weights of the generator and the generator rotor will be greatly reduced, facilitating the implementation of a design solution of the present disclosure (these two processes are available in an article titled Development of 40 MW Series Air Cooled Steam Turbine Generators published in the 4th issue of Electrical Machinery Technology in 2016); and a center of gravity of a generator mounting position is slightly closer towards an outer side of the circular railway;

step 3: providing a multi-stage double-gear accelerated transmission device on a wheel axle of the carriage to convert pulling force of the electric locomotive and the leverage into driving force, thereby driving the generator rotor to reach the rated speed, where the multi-stage double-gear accelerated transmission device relies on the traction of the electric locomotive and the leverage generated between wheels and the wheel-axles to operate and drive the generator rotor, so an energy consumed by the multi-stage double-gear accelerated transmission device is included in a power consumption of the electric locomotive; for example, for an HXD2 electric locomotive, a total power of traction motors is 10,000 KW, and a single electric locomotive can pull a 7,000-ton train; and therefore, in this design solution, large-scale power generation can be achieved as long as a total weight of the carriages, the generators, the transmission devices, various accessories, and additional generator rotors does not exceed 7,000 tons; and step 4: after electricity produced by the generators enters a power grid, a small amount of the electricity enter a special power grid for the annular railway through a shunt circuit to become driving force for the continuous operation of the electric locomotives, where an electromechanical interaction occurs between the traction motors of the electric locomotive and the onboard large generators; the electromechanical interaction is a mutually dependent and continuous interaction, in which the generators rely on a kinetic energy of the traction motors to drive the rotors to reach the rated speed, and the traction motors use the electricity produced by the generators as operating power; a condition for the electromechanical interaction is that the kinetic energy of the traction motor is sufficient for the generator rotor to reach the rated speed and a little part of the electricity produced by the generator becomes the driving force for the continuous operation of the traction motors through the shunt circuit; at present, the electromechanical interaction effect is supposed to be achieved in space; due to weightlessness, the weight of the generator rotor will be greatly reduced, making it possible for the low-power motor to drive the high-power generator to achieve power generation; in the design solution of the present disclosure, the pulling force of the electric locomotive and the huge labor-saving leverage formed between the wheels and the wheel-axles provide kinetic energy guarantee for driving the generator rotors to reach the rated speed, and the electricity produced by generators far exceeds the electricity consumption of electric locomotives; and the electromechanical interaction is a biggest advantage of the large-scale power generation method using electric locomotive-driven generators, which makes the large-scale power generation method using electric locomotive-driven generators different from other power generation methods.

Compared with the prior art, the present disclosure has following beneficial effects:

(1) The present disclosure converts the pulling force of the electric locomotives and the leverage between the wheels and the axles into a driving force through the transmission mechanism provided on the wheel to drive the onboard generator rotors to reach the rated speed, thereby achieving large-scale power generation. After the electricity produced by the generators is grid-connected, a small part of the produced electricity enters the electric locomotive dedicated power grid through the shunt circuit. Based on the mutual conversion between electricity and magnetism, the mechanical traction of kinetic energy, and the enormous leverage between the wheel and the wheel axle, the electromechanical interaction occurs between the traction motors of the electric locomotives and the onboard generators. In this way, a new large-scale power generation method and new electricity production technique has emerged.

(2) The electromechanical interaction effect makes the traction motors and the generators serve as a power source for each other's normal operation and continuous production. This unique phenomenon provides three outstanding advantages for the large-scale power generation method using electric locomotive-driven generators of the present disclosure. First, the large-scale power generation method using electric locomotive-driven generators is low-carbon. Compared to thermal power generation, the large-scale power generation method using electric locomotive-driven generators does not require the combustion of coal or petroleum products, and compared to thermal and nuclear power generation, the large-scale power generation method using electric locomotive-driven generators generates very little heat. Second, the large-scale power generation method using electric locomotive-driven generators is cost-effective. Thermal power generation requires a continuous supply of fuel, while hydropower and nuclear power generation require huge infrastructure investment and maintenance costs. In contrast, the large-scale power generation method using electric locomotive-driven generators greatly reduces construction and maintenance costs. Third, the large-scale power generation method using electric locomotive-driven generators is environmentally friendly and safe. The large-scale power generation method using electric locomotive-driven generators does not generate dust pollutants including carbon dioxide and other harmful substances like thermal power generation does. The large-scale power generation method using electric locomotive-driven generators adopts simple and conventional physical technologies, and avoids destructive effects of hydropower generation on geographical and geological environments, as well as potential nuclear pollution of nuclear power generation.

Figure 1:
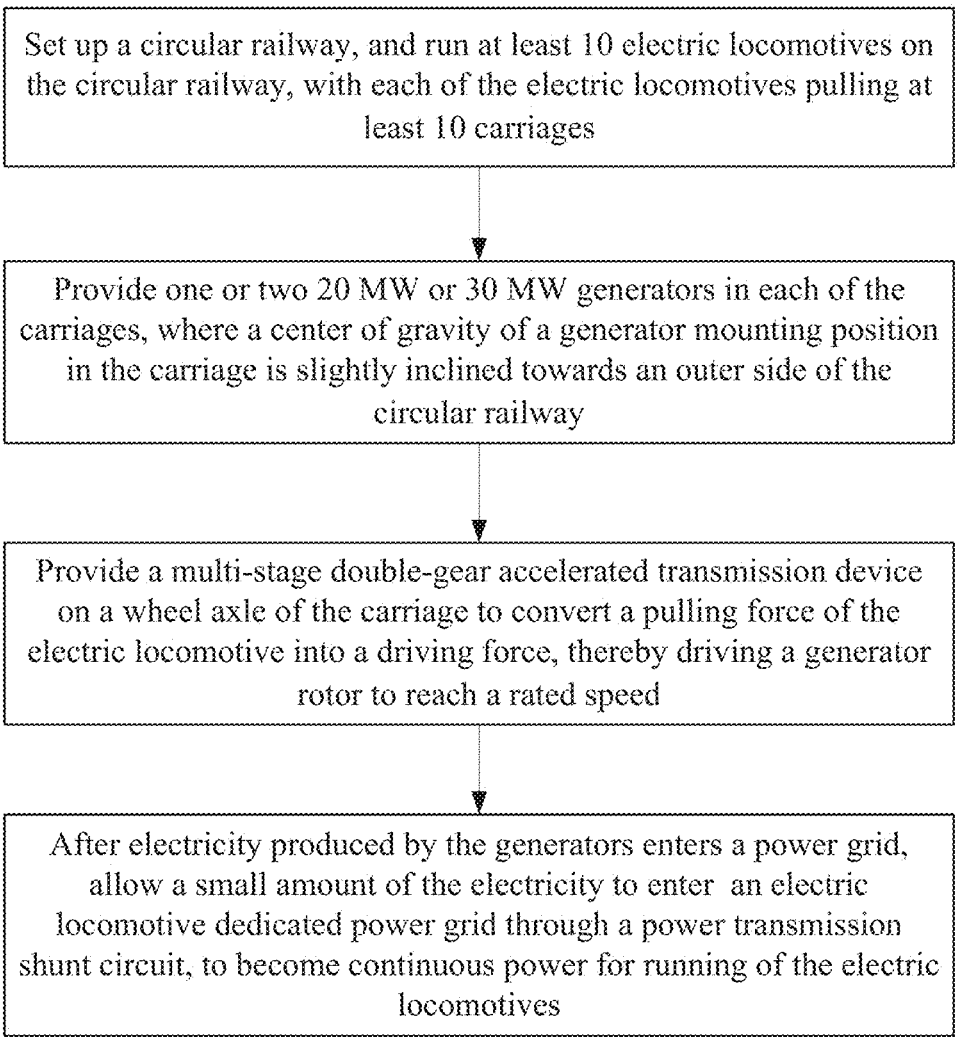
FIG. 1 is a flowchart of a large-scale power generation method using electric locomotive-driven generators according to the present disclosure.

Reference Numerals: 1. wheel axle; 2. primary transmission gear; 3. dual transmission gear; 4. end-level conical spiral dual-gear; 5. conical spiral gear at generator rotor end; 6. generator; 7. gearbox casing; 8. upper support bracket; 9. positioning surface; 10. mounting base; 11. lower support bracket; 12. wheel; 14. generator rotor; 15. carriage; 16. transmission circuit; 17. electric locomotive; 21. dedicated power grid; and 23. railway.

DESCRIPTION OF EMBODIMENTS

The technical solutions in the embodiments of the present disclosure will be clearly and completely described below with reference to the accompanying drawings in the embodiments of the present disclosure. It should be understood that the specific embodiments described herein are merely a part of the embodiments of the present disclosure, but not all of the embodiments. All other embodiments obtained by a person skilled in the art based on the embodiments of the present disclosure without creative efforts shall fall within the protection scope of the present disclosure.

Example 1

Referring to FIG. 1, a large-scale power generation method using electric locomotive-driven generators, includes following steps:

step 1: setting up a circular railway, and run at least 10 electric locomotives on the circular railway, and each of the electric locomotives pulls at least 10 carriages;

step 2: providing one or two 20 MW or 30 MW generators in each of the carriages, wherein a center of gravity of a generator mounting position in the carriage is slightly closer towards an outer side of the circular railway to prevent the electric locomotives from tilting inward due to the electric locomotive's circular operation;

step 3: providing a multi-stage double-gear accelerated transmission device on a wheel-axle of the carriage, which relies on the traction of the electric locomotives and the leverage generated between wheels and the wheel axles to drive generator rotors to reach the rated speed (this electrical energy production technology does not require the electric locomotive to be operated at full load); and step 4: after electricity produced by the generators enters a power grid, a small amount of the electricity enter an electric locomotive dedicated power grid through a power transmission shunt circuit, to become continuous power for running of the electric locomotives, thereby, a structural electromechanical interaction is formed between the traction motors of the electric locomotives and the onboard generators.

Example 2 side walls and tops of the carriage at either side of the generator mounting position are detachable or slidably openable and closable, facilitating the mounting and maintenance of the generators and the multi-stage double-gear accelerated transmission device; the side walls and the tops of the carriages are made of lightweight material to reduce a weight of the carriages; and 1 or 2 pairs of wheels are added to increase a load-bearing capacity of a carriage chassis and facilitate the mounting of the multi-stage double-gear accelerated transmission devices.

Example 3 a mounting base is firmly placed on the carriage chassis above wheel and is fixedly provided with the generator and the multi-stage double-gear accelerated transmission device to prevent the generator and the multi-stage double-gear accelerated transmission device from swinging or vibrating due to respective rotations, thereby the generators and the multi-stage double-gear accelerated transmission devices adapt to the carriage to ensure normal train operation;

the center of gravity of the generator mounting position is slightly closer towards the outer side of the circular railway to prevent the generators from tilting inward due to the electric locomotive's circular operation.

Example 4 the multi-stage double-gear accelerated transmission device includes a primary transmission gear, dual-gears, and an end conical dual-gears; the primary transmission gear is provided on the wheel axle; the primary gear has a diameter slightly smaller than a diameter of the wheel; the primary transmission gear meshes with a small gear of a secondary dual transmission gear to initiate an acceleration effect; a big gear of the secondary dual transmission gear meshes with a small gear of a tertiary dual transmission gear to gradually accelerate until an end-level conical spiral dual-gear; and the end-level conical spiral dual-gear meshes with a conical spiral gear provided at a generator rotor end to drive the generator rotor to reach the rated speed.

Example 5

Figure 2:
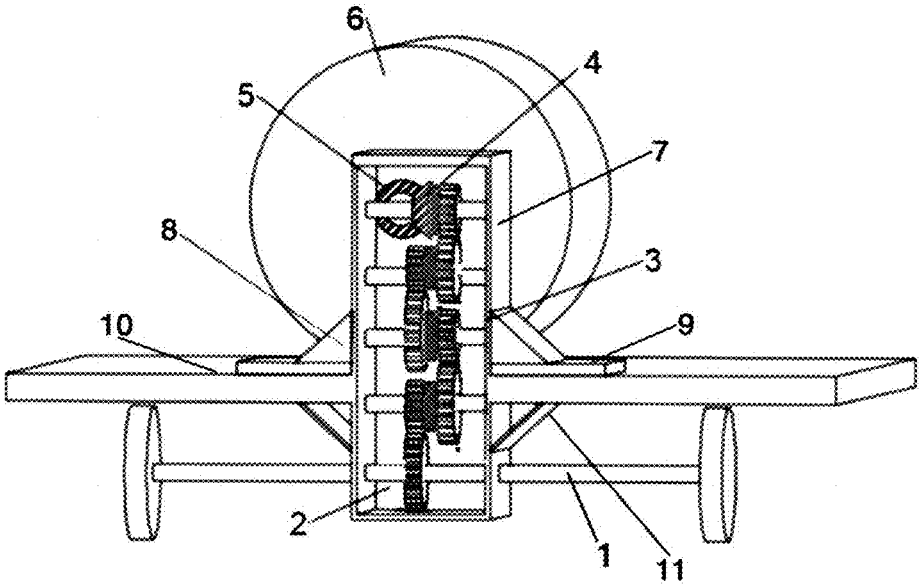
FIG. 2 is a schematic diagram showing that a multi-stage double-gear accelerated transmission structure meshes with generator.
Figure 3:
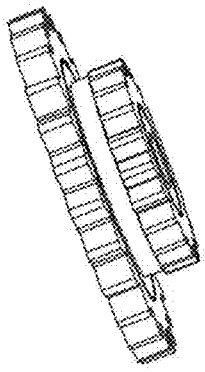
FIG. 3 is a schematic diagram of dual transmission gears.
Figure 4:
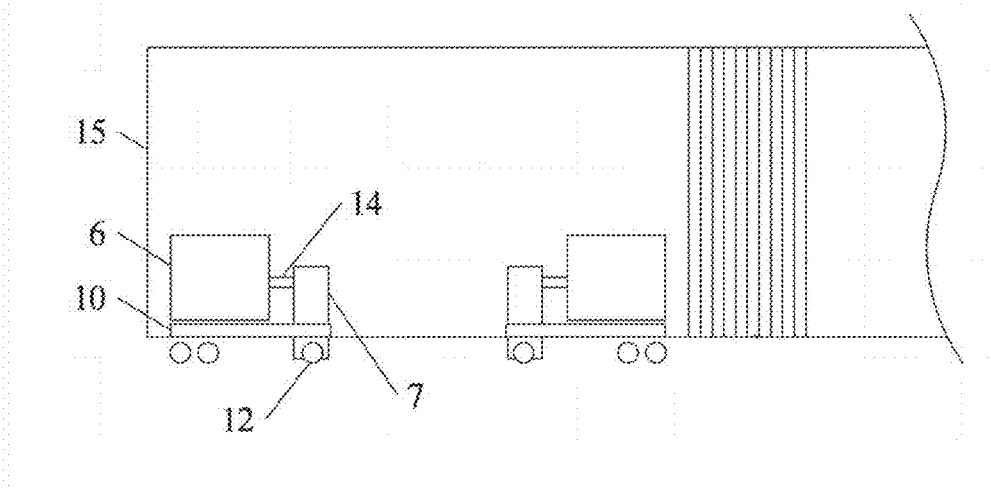
FIG. 4 is a schematic diagram of a carriage.
Figure 5:
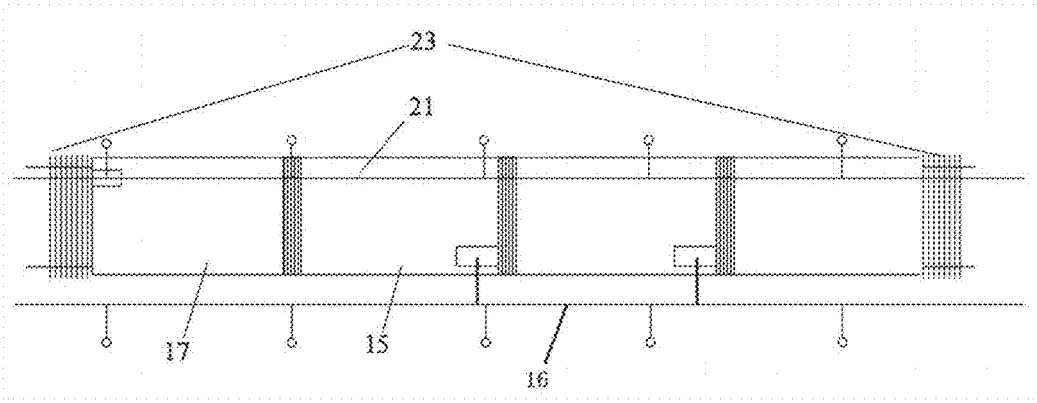
FIG. 5 is a top view of electric locomotives and carriages.

Referring to FIGS. 2-3, a gearbox casing 7 is made of steel, has a thickness of 2 cm or more, and includes an upper part and a lower part; the upper part of the gearbox casing 7 is provided on a steel mounting base surface 10 of a generator mounting surface inside the carriage, with each side provided with two upper support brackets 8 and two lower support brackets 11 that are at a right angle; the upper part of the gearbox casing is divided in half in a direction of the generator 6 rotor for easy gear mounting and maintenance and are combined through an edge screw hole; the upper part of the gearbox casing 7 extends downwards to a center position of the primary transmission gear 2 and is horizontally connected and tightened with the lower part of the gearbox casing; the upper part and the lower part of the gearbox casing close to the wheel are formed into two semicircles that are butted through the wheel; the lower part of the gearbox casing is in an integrated form and made of a lightweight material; and a top of the gearbox casing is provided with a movable cover to facilitate maintenance.

Example 6 the electricity produced by the generators is sent through a transmission circuit (namely a contact-type transmission circuit) provided on a pole outside the train to a power station and then grid-connected; and a small part of the produced electricity enters the electric locomotive dedicated power grid through the shunt circuit.

Electric energy of a power grid is used as an initial power (if it is a regional independent power supply facility, a internal combustion locomotive or a steam locomotive may be used to drag a plurality of large generators according to the technology to produce electricity to enter the dedicated power grid for the electric locomotives, which is used as an initial power for producing electricity by other electric locomotives in this technical mode; once power generation of the electric locomotives meets the requirement of power supply of the power grid, the power generation of the internal combustion locomotive or the steam locomotive can be stopped.

The invention claimed is:

1. A power generation method using electric locomotive-driven generators, comprising following steps:

step 1: setting up a circular railway, and running at least 10 electric locomotives on the circular railway, with each of the electric locomotives pulling at least 10 carriages;

step 2: providing one 20 MW generator in each of the carriages, wherein a center of gravity of a generator mounting position in the carriage is slightly closer towards an outer side of the circular railway;

step 3: providing a multi-stage double-gear accelerated transmission device on a wheel axle of the carriage to convert pulling force of the electric locomotive into driving force, thereby driving a generator rotor to reach the rated speed; and step 4: after electricity produced by the generators enters a power grid, a small amount of the electricity enters an electric locomotive dedicated power grid through a power transmission shunt circuit, to become continuous power for running of the electric locomotives.

2. The power generation method using electric locomotive-driven generators according to claim 1, wherein side walls and tops of the carriage at either side of the generator mounting position are detachable or slidably openable and closable, and are made of a lightweight material; and each generator mounting position is located above wheels; on carriage chassis is fixed a steel mounting base with a length larger than a sum of a length of the generator and a length of the multi-stage double-gear accelerated transmission device, with a width equal to a width of a carriage floor, and with a thickness between 3.5 cm and 4.5 cm; the steel mounting base is provided with the generator and the multi-stage double-gear accelerated transmission device; and 1 or 2 pairs of wheels are added to increase a load-bearing capacity of the carriage chassis.

3. The power generation method using electric locomotive-driven generators according to claim 1, wherein the multi-stage double-gear accelerated transmission device comprises a primary gear provided on the wheel axle; and as the wheel rotates, the multi-stage double-gear accelerated transmission device converts the pulling force of the electric locomotive into driving force to drive the generator rotor to reach the rated speed.

4. The power generation method using electric locomotive-driven generators according to claim 1, wherein the multi-stage double-gear accelerated transmission device is vertically provided on the steel mounting base through a primary gear integrated with the wheel axle, thereby the rotor end spiral conical gear meshes with the end spiral conical dual-gear of gearbox at a 90-degree angle.

5. The power generation method using electric locomotive-driven generators according to claim 1, wherein the electric locomotives use the electricity from the power grid to pull an entire train for operation; the multi-stage double-gear accelerated transmission device converts the pulling force of the electric locomotives into the driving force for the generators to produce electricity; the produced electricity is grid-connected after entering a power station, during which the power station replaces the power grid with a small amount of produced electricity through the power transmission shunt circuit to supply power to a special electric circuit for the electric locomotives, and a constant supply of power from the power transmission shunt circuit becomes the driving force for the continuous operation of the electric locomotives; and then an electromechanical interaction occurs between the generators and traction motors, ensuring long-term continuous progress of power generation of large generators driven by the electric locomotives.

* * * * *